United States Patent [19]

Foster

[11] Patent Number: 4,662,851

[45] Date of Patent: May 5, 1987

[54] SWIM FLOAT

[75] Inventor: John K. Foster, Harwichport, Mass.

[73] Assignee: Packaging Industries Group, Inc., Hyannis, Mass.

[21] Appl. No.: 753,259

[22] Filed: Jul. 9, 1985

[51] Int. Cl.[4] ..... B63B 35/72

[52] U.S. Cl. ..... 441/129; 441/35; 5/481

[58] Field of Search ..... 441/35, 80, 40, 88, 441/125, 126, 127, 129, 130, 136, 139, 106, 107, 114, 115, 113; 114/266, 267; 5/419, 420, 481

[56] References Cited

U.S. PATENT DOCUMENTS 3,323,151 6/1967 Lerman ..... 441/127
4,138,753 2/1979 Wood ..... 441/129

FOREIGN PATENT DOCUMENTS 2751815 5/1979 Fed. Rep. of Germany ..... 5/420
11428 6/1893 United Kingdom .

*Primary Examiner*—Sherman D. Basinger
*Assistant Examiner*—Edwin L. Swinehart
*Attorney, Agent, or Firm*—Berman, Aisenberg & Platt

[57] ABSTRACT

A swim float constructed of a plurality of hinged sections. Core blocks are hingedly interconnected by upper and lower flexible layers. Sidewalls of adjacent flexible layers are bevelled so that the skin of a user will not be pinched therebetween. The hinges alternatingly are formed by the upper and lower flexible layers so that the swim float flexes and follows the contour of waves.

10 Claims, 4 Drawing Figures

SWIM FLOAT

FIELD OF THE INVENTION

This invention relates generally to swim floats and more particularly to a swim float made from a plurality of sections constructed of polyolefin foam layers. The present swim float advantageously includes bevelled hinges that do not pinch a user.

BACKGROUND OF THE INVENTION

Inflatable swim floats and rafts are well-known. Inflatable rafts, although capable of supporting the weight of an adult, suffer from several disadvantages. These rafts must be inflated and deflated with each use and are easily punctured, ripped or torn. More importantly, inflatable rafts are not suitable for use by young children. A sudden loss of air pressure may leave a child helpless.

Swim rafts constructed from flexible, cellular solids offer advantages over inflatable rafts. Thes rafts do not require inflating or patching, and are approved for use by young children because they cannot "deflate".

U.S. Pat. No. 1,829,137 (Harris) discloses a bathing float constructed from a series of cork sections surrounded by a canvas covering. The sections are rigidly secured by wooden rods passing through loops attached to the ends of the cork panels. U.S. Pat. No. 3,380,088 (d'Adesky) illustrates a combination floating mattress and beach pad constructed of a plurality of polyethylene foam floats. A plurality of ropes interconnect the float members. U.S. Pat. No. 4,275,473 (Poirer) teaches a buoyant mattress constructed of a plurality of lightweight, buoyant blocks. The blocks are surrounded and interconnected by an outer skin of fabric, polyethylene or polyvinylchloride film.

Inflatable mattresses are illustrated in U.S. Pat. No. 3,428,974 (Stuart) and U.S. Pat. No. 2,850,252 (Ford). A wave attentuating device comprising a plurality of liquid-filled chambers is illustrated in U.S. Pat. No. 3,237,414 (Straub, et al.), and U.S. Pat. No. 4,451,240 (Wood) discloses a closed-cell foam aquatic mat including a buoyant headrest.

Many of the prior floats and mattresses are rigid and thus are not easily stored in a closet or the trunk of an automobile. Thus, a hinged swim float is desired. In addition to being foldable, a hinged mat can readily follow the contour of ocean waves. The hinges must be carefully designed, however, so that they do not pinch the skin of a person lying on the mat. U.S. Pat. No. 3,284,819 (Nissen) illustrates a folding gymnastic floor mat. The hinge structure of this mat would not be suitable for use in an aquatic mat because the hinges would pinch a user.

Accordingly, it is an object of the present invention to provide a swim float constructed of a plurality of hinged sections.

Another object of the present invention is to provide a swim float constructed of closed-cell foamed plastic material.

A further object of the present invention is to provide hinged float sections that do not pinch a user.

SUMMARY OF THE INVENTION

The present invention provides a flexible, foldable swim float which does not suffer from the previously-mentioned disadvantages. The float is constructed of a core layer of cellular foam blocks. Flexible outer layers of cellular material are disposed on the upper and lower surfaces of the core layer and join adjacent core blocks. The outer layers are not continuous and join, in a staggered manner, the upper or lower surfaces of adjacent core blocks.

DETAILED DESCRIPTION

Figure 1:
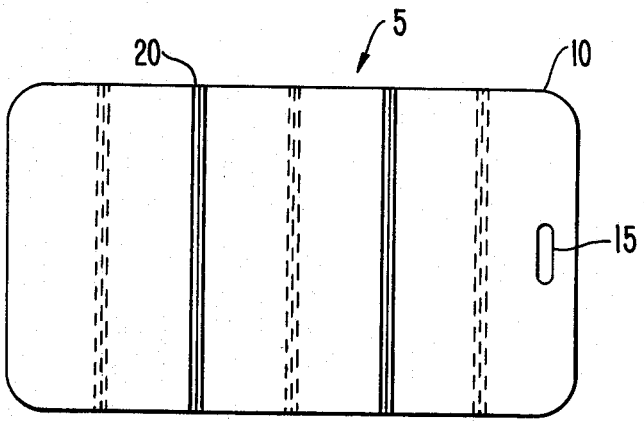
FIG. 1 is a plan view of a preferred embodiment of the present swim float.

Referring now to FIG. 1, a preferred embodiment of the present swim float is illustrated and designated generally by the reference numeral 5. The float 5 is constructed of a plurality of sections 10 which are hingedly interconnected at hinge region 20. As seen in FIG. 1, the hinges are alternatingly formed by the upper and lower flexible layers of the float. A handle 15 is formed in the front section 10 of the swim float.

Figure 2:
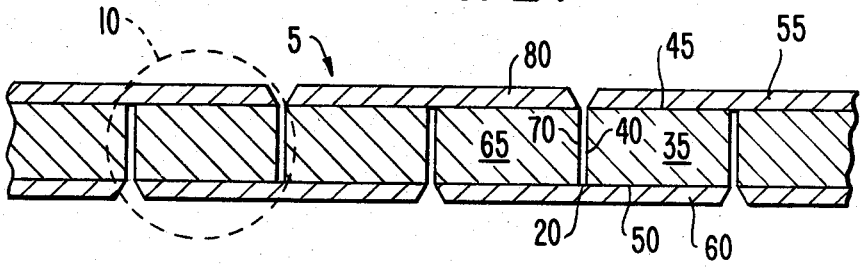
FIG. 2 is a side view of the swim float of FIG. 1.

As seen in FIG. 2, the present float is constructed of a plurality of sections 10 which comprise "repeating units." Each section 10 is constructed of three distinct layers and includes a core block 35 having side walls 40, an upper surface 45 and a lower surface 50. A first flexible layer 55 is disposed on upper surface 45 and a second flexible layer 60 is similarly disposed on the lower surface 50 of core block 35. The flexible layers preferably are coextensive with the upper and lower surfaces of the core blocks.

Figure 3:
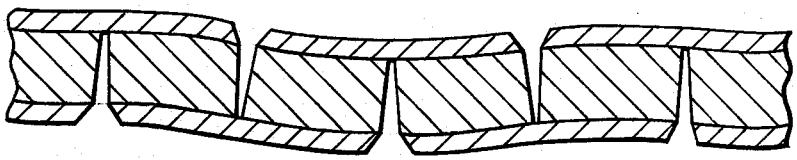
FIG. 3 is a view of the swim float of FIG. 2 in a flexed state.

A second core block 65 lies next to core block 35 so that sidewall 70 of block 65 faces and is disposed adjacent to sidewall 40 of block 35. Flexible layer 60 is disposed on the lower surface of core blocks 65 and 35 and thus hingedly interconnects blocks 35 and 65 in hinge region 20. A third flexible layer 80 is disposed on the upper surface of block 65. Flexible layers 55 and 80 are not continuous so that the float sections may flex as seen in FIG. 3. As seen in FIG. 2, the sidewalls of the flexible layers 55 and 80 are bevelled away from each other so as to form an angle therebetween. This beveling insures that a user's skin will not become pinched between adjacent flexible layers. The sidewalls of adjacent flexible layers preferably form a 90 degree angle.

It will be appreciated that a swim float comprising two core blocks is merely one embodiment of the present invention. Other embodiments comprise a plurality of core blocks which are interconnected at hinge regions which are staggered in the upper and lower flexible layers as illustrated in FIG. 2. The number of sections 10 which are present in a given embodiment is dictated by the overall length and degree of flexibility desired; flexibility increases as the number of sections per unit length increases.

Figure 4:
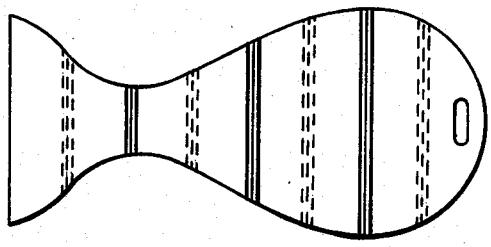
FIG. 4 is a plan view of an alternate embodiment of the present swim float.

FIG. 3 illustrates the swim float 5 in a flexed state. In use the float sections constantly flex as a rider negotiates ocean waves or paddles around a swimming pool. The bevelled sidewalls of the flexible layers insure that a user's skin will not become pinched as each pair of flexed sections returns to its unflexed state. FIG. 4 illustrates a swim float according to the present invention and shaped like a fish. The present float may be manufactured in a variety of shapes, all of which employ the bevelled hinge construction illustrated in FIG. 2.

The core blocks 35, etc., are constructed of any lightweight material which is significantly less dense than water. The flexible layers are also constructed of buoyant material. In a preferred embodiment, the core blocks and flexible layers are constructed of closed cell polyeolefin foam. The flexible layer foam preferably is denser than and about twice as dense as the core block foam. In one embodiment, the core blocks are constructed of closed cell polyethylene foam of approximately 2.5 pounds per cubic foot density and the flexible layers are constructed of polyethylene foam having a density of approximately 5 pounds per cubic foot. The flexible layers are connected to the core blocks by a suitable adhesive. The size of the float may vary and a float which measures 30 inches by 60 inches is suitable for use by young people and adults. The float is preferably 1.5 inches thick, the core blocks being 1.0 inches thick and each of the flexible layers being 0.25 inches thick. Each section 10 is preferably four inches wide.

Variations of the invention within the scope of the appended claims will be apparent to those of skill in the art.

What is claimed is:

1. A swim float comprising first and second core blocks having sidewalls which are substantially parallel, facing each other and disposed adjacent to each other;

a first flexible layer disposed on upper surfaces of said core blocks whereby the flexible layer hingedly interconnects said core blocks in a hinge region;

second and third flexible layers, the second flexible layer disposed on and extending along a lower surface of the first core block, and the third flexible layer disposed on and extending along a lower surface of the second core block;

said second and third layers having sidewalls disposed opposite the hinge region, said sidewalls being bevelled and forming an angle therebetween, said core blocks and said flexible layers comprising foamed plastic material.

2. A swim float of claim 1 wherein said angle is a 90 degree angle.

3. A swim float of claim 1 further comprising third and fourth core blocks wherein said second flexible layer hingedly connects and is coextensive with lower surfaces of said first and third core blocks and said third flexible layer hingedly connects and is coextensive with lower surfaces of said second and fourth core blocks.

4. A swim float of claim 3 further comprising additional core blocks hingedly connected to adjacent core blocks by flexible layers.

5. A swim float of claim 4 wherein said flexible layers are coextensible with outer surfaces of said core blocks.

6. A swim float of claim 3 wherein said core blocks and said flexible layers comprise closed-cell foamed plastic material.

7. A swim float of claim 6 wherein the density of said flexible layers is greater than the density of said core blocks.

8. A swim float of claim 6 wherein the density of said flexible layers is approximately twice the density of said core blocks.

9. A swim float of claim 6 wherein said closed-cell foamed plastic material is polyolefin.

10. A swim float of claim 9 wherein said polyolefin is polyethylene.

* * * * *